US012673811B2

(12) United States Patent
Coles

(10) Patent No.: US 12,673,811 B2
(45) Date of Patent: Jul. 7, 2026

(54) THERMALLY INSULATIVE LINER FOR USE IN PACKAGING

(71) Applicant: Agile Box Ltd., Norfolk (GB)

(72) Inventor: Christopher Coles, Norfolk (GB)

(73) Assignee: Agile Box Ltd, Norfolk (GB)

( * ) Notice: Subject to any disclaimer, the term of this patent is extended or adjusted under 35 U.S.C. 154(b) by 94 days.

(21) Appl. No.: 18/552,545

(22) PCT Filed: Mar. 31, 2022

(86) PCT No.: PCT/EP2022/058595

§ 371 (c)(1),
(2) Date: Sep. 26, 2023

(87) PCT Pub. No.: WO2022/207801

PCT Pub. Date: Oct. 6, 2022

(65) Prior Publication Data

US 2024/0158155 A1 May 16, 2024

(30) Foreign Application Priority Data

Mar. 31, 2021 (GB) ..... 2104682

(51) Int. Cl.
*B65D 81/38* (2006.01)

(52) U.S. Cl.
CPC ..... *B65D 81/386* (2013.01)

(58) Field of Classification Search
CPC .... B65D 81/386; B65D 5/566; B65D 65/403; B65D 81/3858; B65D 81/3853; B65D 5/30; B65D 81/18; B65D 81/3897; B65D 25/02; B65D 5/58; B32B 2307/304; B31B 2120/40; B31B 2170/20; Y02W 30/80; F25D 2331/804
USPC .... 229/103.11, 939, 117.27, 117.35, 122.32, 229/122.34; 206/591, 521, 594; 220/592.2, 592.21, 920; 428/116, 34.2; 493/903, 100, 93, 95; 53/472
See application file for complete search history.

(56) References Cited

U.S. PATENT DOCUMENTS 3,880,341 A * 4/1975 Bamburg ..... B65D 5/566 229/122.32
5,230,941 A * 7/1993 Hollander ..... B65D 81/3853 428/116
7,021,524 B1 * 4/2006 Becker ..... B65D 81/127 493/93
10,745,187 B1 8/2020 Vincent et al.
(Continued)

FOREIGN PATENT DOCUMENTS

WO 99/032374 A1 7/1999

*Primary Examiner* — Christopher R Demeree
(74) *Attorney, Agent, or Firm* — Young Basile Hanlon & MacFarlane, P.C.

(57) ABSTRACT

A thermally insulative liner for a box is described. The liner includes a base and a plurality of sidewalls. Each sidewall extends from the base thereby to define an opening opposite the base. Each of the plurality of sidewalls includes an inner surface, an outer surface, and a plurality of channels formed between the inner surface and the outer surface and extending parallel with the inner surface and the outer surface. A first sidewall of the plurality of sidewalls contacts two other sidewalls of the plurality of sidewalls. One or more of the plurality of channels in the first sidewall is closed at opposing ends by the respective inner surfaces of the two other sidewalls.

19 Claims, 8 Drawing Sheets

(56) References Cited

U.S. PATENT DOCUMENTS

| | | | | |
|---|---|---|---|---|
| 11,691,402 | B2 * | 7/2023 | Cardinale | B32B 27/36<br>428/480 |
| 2012/0193365 | A1 | 8/2012 | Humphries et al. | |
| 2020/0055630 | A1 | 2/2020 | de Lesseux et al. | |

* cited by examiner

THERMALLY INSULATIVE LINER FOR USE IN PACKAGING

TECHNICAL FIELD

The present invention relates to thermally insulative packaging and thermally insulating liners for packaging.

BACKGROUND

User-assembled, or 'flat-pack', packaging is used in a variety of industries as a cost-effective and logistically straightforward solution to the problem of packaging and transporting goods.

SUMMARY

In many applications, it is desirable to provide flat-pack packaging that packs in a space-efficient manner prior to assembly but nevertheless forms a robust and well-supported structure upon assembly. Such applications include, for example, the packaging of white goods, construction materials, and furniture.

In many applications, it is desirable to provide packaging that provides improved thermal insulation. For example, it is desirable in some applications to improve the heat retention of the goods packaged therein, thereby to house goods at a desired temperature above that of the ambient surroundings. Such applications include, for example, the distribution of perishable goods, hot or cooked foodstuffs, construction materials, and medical supplies.

Alternatively, it is desirable in other applications to mitigate heat transfer to the goods enclosed within the packaging, thereby to house goods at a desired temperature below that of the ambient surroundings. Such applications include, for example, the distribution of perishable goods, cold or raw foodstuffs, construction materials, and medical supplies.

The present inventors have identified that some conventional flat-pack packaging is difficult and costly to manufacture, is susceptible upon assembly to fatigue and breakage under heavy load, is insufficiently thermally insulating upon assembly for many applications, is prone to incomplete assembly and accidental spillage, breakage, or undesirable cooling/heating, is environmentally unsustainable to manufacture or dispose of, or combinations thereof.

Specifically, flat-pack packaging formed predominantly of flat sheet material may provide insufficient robustness and thermal insulation for many applications. Alternatively, in some existing packaging, packaging comprises fluted or corrugated sheets may provide sub-optimal thermal insulation (because air can enter and exit the open-ended cavities defined by the flutes) and limited rigidity.

Therefore, it is desirable to provide flat-pack packaging that is simultaneously cost-effective to manufacture and distribute, sufficiently robust to mitigate the likelihood of packaging fatigue or breakage under load, sufficiently thermally insulating to improve the longevity of perishable or heat-sensitive goods enclosed therein, and at least partially auto-assembling or auto-sealing. It is more desirable still that such packaging be formed entirely of environmentally sustainable materials.

In a first aspect, there is provided a thermally insulative liner for a box, the liner including a base and a plurality of sidewalls. Each sidewall extends from the base thereby to define an opening opposite the base. Each of the plurality of sidewalls includes an inner surface, an outer surface, and a plurality of channels formed between the inner surface and the outer surface and extending parallel with the inner surface and the outer surface. A first sidewall of the plurality of sidewalls contacts two other sidewalls of the plurality of sidewalls. One or more of the plurality of channels in the first sidewall is closed at opposing ends by the respective inner surfaces of the two other sidewalls.

The thermally insulative liner may further include a cover extending across the opening, thereby to define an enclosed volume of the liner.

A width of the first sidewall, at least somewhere along its length, may be greater than a width of the first sidewall at the base.

The width of the first sidewall may increase in a direction from the base to the opening.

Each plurality of channels may be formed by a fluted or corrugated sheet sandwiched between the respective inner surface and the respective outer surface.

The thermally insulative liner may further include a closing segment rotatably attached to a second sidewall of the plurality of sidewalls at a top end of the second sidewall, the top end being an end of the second sidewall furthest from the base.

The closing segment may be configured to close one or more of the plurality of channels in the second sidewall at the top end.

The second wall may be one of the two other sidewalls.

The closing segment may be further configured to close one or more of the plurality of channels in a third sidewall of the plurality of sidewalls.

The thermally insulative liner may further include a further closing segment rotatably attached to a third sidewall of the plurality of sidewalls at a top end of the third sidewall, the top end being an end of the third sidewall furthest from the base.

The further closing segment may be configured to close one or more of the plurality of channels in the third sidewall at said top end of the third sidewall.

The second sidewall may be one of the two other sidewalls and the third sidewall is an opposite one of the two other sidewalls.

The closing segment may be configured to extend entirely across the opening, thereby to form the cover defining the enclosed volume between the cover, the base, and the plurality of sidewalls.

The closing segment and the further closing segment may each be configured to extend across, and meet within, the opening, thereby to together form the cover defining the enclosed volume between the cover, the base, and the plurality of sidewalls.

One of more of the plurality of channels in one or both of the two other sidewalls may be closed at a top end by the cover, the top end being an end opposite the base.

The plurality of channels of the first sidewall may extend in a direction substantially parallel to the base.

The pluralities of channels of the two other sidewalls may extend in a direction substantially perpendicular to the base.

One or more of the plurality of channels of a sidewall of the plurality of sidewalls may extend in a direction having both a component parallel to the base and a component perpendicular to the base.

The liner may comprise one or more materials selected from the group of materials consisting of a recycled material, a recyclable material, a biodegradable material, paper, card, cardboard, corrugated cardboard, wood, polymer, and a cellulose fibre material.

Contact of each sidewall of the plurality of sidewalls of the liner with respective box sidewalls may displace each of the two other sidewalls of the liner towards the first sidewall, such that a greater number of the plurality of channels in said first sidewall is closed by the two other sidewalls than are otherwise closed by the two other sidewalls in the isolated liner.

In a second aspect, there is provided a thermally insulative packaging including outer packaging defining an internal volume and a thermally insulative liner located within the internal volume of the outer packaging. The thermally insulative liner is in accordance with that of the first aspect above.

The outer packaging may be a box that includes a box base, a plurality of box sidewalls extending from the base, the plurality of box sidewalls defining a box opening to the internal volume of the outer and the box opening being opposite to the box base; and a box cover configured to cover the box opening.

One or more of the plurality of channels in a sidewall of the plurality of sidewalls may be closed at a top end of said sidewall by the box cover.

The box cover and the cover may be spaced apart thereby to define a cavity therebetween.

In a third aspect, there is provided a method for assembling thermally insulative packaging. The method includes providing outer packaging, the outer packaging defining an internal volume, and inserting a thermally insulative liner into the internal volume of the outer packaging. The thermally insulative liner is in accordance with that of the first aspect above.

Inserting the thermally insulative liner into the internal volume of the outer packaging may include inserting the thermally insulative liner into the internal volume of the outer packaging such that the base is disposed against a base of the outer packaging and such that each sidewall of the plurality of sidewalls is disposed against a respective sidewall of the outer packaging.

The method may further include, after inserting the thermally insulative liner into the internal volume of the outer packaging, inserting goods into the internal volume.

The thermally insulative liner may further include a cover configured to extend across the opening. The method may further include, thereafter, closing, by the cover, the opening of the thermally insulative liner, and closing, by a further cover of the outer packaging, a further opening to the internal volume of the outer packaging.

In a fourth aspect, there is provided a thermally insulative liner for a box, the liner including a base, a first sidewall extending from the base, a second sidewall extending from the base, the second sidewall being opposite the first sidewall, a third sidewall extending from the base, the third sidewall extending between the first sidewall and the second sidewall, and a fourth sidewall extending from the base, the fourth sidewall being opposite the third sidewall. The fourth sidewall extends between the first sidewall and the second sidewall. The liner further includes an opening defined by the sidewalls, the opening being opposite the base. Each of the first, second, third, and fourth sidewalls includes a plurality of channels. The plurality of channels in the first sidewall and the plurality of channels in the second sidewall each extend parallel with the base. The plurality of channels in the third sidewall and the fourth sidewall each extend perpendicular to the base. One or more of the plurality of channels in each of the first sidewall and the second sidewall is closed at opposing ends by the third sidewall and the fourth sidewall.

The thermally insulative liner may further include a cover extending across the opening, thereby to define an enclosed volume of the liner. One or more of the plurality of channels in each of the third sidewall and the fourth sidewall may be closed at respective top ends by the cover.

DETAILED DESCRIPTION

It will be appreciated that relative terms such as above and below, horizontal and vertical, top and bottom, front and back, and so on, are used herein merely for ease of reference to the drawings, and these terms are not limiting as such, and any two differing directions or positions and so on may be implemented rather than truly above and below, horizontal and vertical, top and bottom, and so on.

Figure 1:
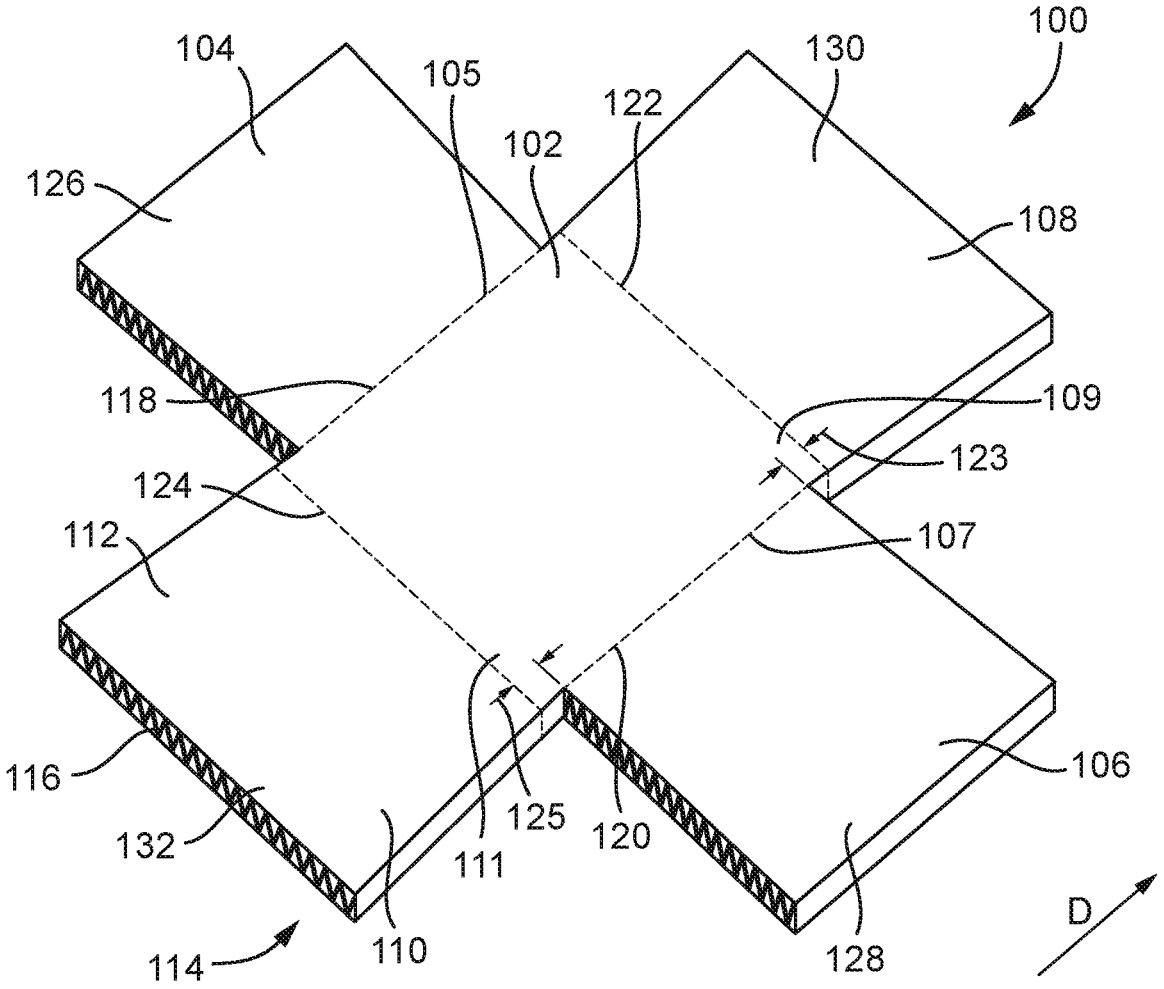
FIG. 1 is a schematic illustration (not to scale) showing a perspective view of a thermally insulative liner for packaging.

FIG. 1 is a schematic illustration (not to scale) showing a perspective view of a thermally insulative liner 100 for packaging.

In this embodiment, the thermally insulative liner 100 comprises a base 102.

A first arm 104 extends, in a first direction, from a first edge 105 of the base 102.

A second arm 106 extends, in a second direction opposite to the first direction, from a second edge 107 of the base 102. The second edge 107 of the base 102 is opposite the first edge 105 of the base 102.

A third arm 108 extends, in a third direction perpendicular to the first and second directions, from a third edge 109 of the base 102. The third edge 109 extends between the first edge 105 and the second edge 107.

A fourth arm 110 extends, in a fourth direction opposite to the third direction, from a fourth edge 111 of the base 102. The fourth edge 111 of the base 102 is opposite the third edge 109 of the base 102.

The arms 104, 106, 108, 110 extend from the base 102. FIG. 1 shows the thermally insulative liner 100 in an unfolded configuration. As will be clear from the description below, in a folded configuration of the thermally insulative liner 100, the arms 104, 106, 108, 110 form walls (in particular, sidewalls) of the liner 100. Accordingly, the first arm 104, the second arm 106, the third arm 108, and the fourth arm 110 are hereinafter referred to as "the first wall" 104, "the second wall" 106, "the third wall" 108, and "the fourth wall" 110, respectively.

The thermally insulative liner 100 is a sheet of material comprising a first surface 112 and a second surface 114 opposing the first surface 112. The thermally insulative liner 100 further comprises a core 116 sandwiched between the first surface 112 and the second surface 114.

In this embodiment, the core 116 comprises a fluted or corrugated sheet. The fluted or corrugated sheet defines a plurality of channels or cavities between, and extending parallel to, the first and second surfaces 112, 114. Specifically, each of the plurality of channels or cavities defined by the fluted or corrugated sheet extends in the same direction D (indicated by an arrow in FIG. 1). In other words, the channels or cavities are coplanar and substantially parallel when the liner is in its unfolded (i.e., flat) configuration. Thus, the thermally insulative liner 100 may be formed of a single sheet of material having the core 116 comprising a fluted or corrugated sheet (e.g., a corrugated cardboard sheet). This tends to reduce the cost and duration of manufacture of the thermally insulative liner 100.

The thermally insulative liner 100 comprises a first crease 118 in the sheet of material at the first edge 105. The first crease 118 extends perpendicular to the first direction, i.e., the first crease 118 is a transverse crease. The first crease 118 facilitates rotation of the first wall 104, from a position in which it is aligned and lies flush with the base 102, in a first rotation direction relative to the base 102.

The thermally insulative liner 100 comprises a second crease 120 in the sheet of material at the second edge 107. The second crease 120 extends perpendicular to the second direction, i.e., the second crease 120 is a transverse crease. The second crease 120 facilitates rotation of the second wall 106 in a second rotation direction, from a position in which it is aligned and lies flush with the base 102, relative to the base 102. The second rotation direction is opposite to the first rotation direction.

The thermally insulative liner 100 comprises a third crease 122 in the sheet of material proximate the third edge 109. The third crease 122 extends across the third arm 108 perpendicular to the third direction, i.e., the third crease 122 is a transverse crease. The third crease 122 facilitates rotation of at least part of the third wall 108 in a third rotation direction, from a position in which it is aligned and lies flush with the base 102, relative to the base 102.

The thermally insulative liner 100 comprises a fourth crease 124 in the sheet of material proximate the fourth edge 111. The fourth crease 124 extends across the fourth arm 110 perpendicular to the fourth direction, i.e., the fourth crease 124 is a transverse crease. The fourth crease 124 facilitates rotation of at least part of the fourth wall 110 in a fourth rotation direction, from a position in which it is aligned and lies flush with the base 102, relative to the base 102. The fourth rotation direction is opposite to the third rotation direction.

In this embodiment, the first crease 118 extends along the first edge 105. The second crease 120 extends along the second edge 107.

In this embodiment, the third crease 122 is displaced or offset from the third edge 109, i.e., there in a non-zero distance 123 from the third crease 122 in the third wall 108 to the base 102.

In this embodiment, the fourth crease 124 is displaced or offset from the fourth edge 111, i.e., there in a non-zero distance 125 from the fourth crease 124 in the fourth wall 110 to the base 102.

Each of the first crease, second crease, third crease, and fourth crease 118, 120, 122, 124 is a crease, or score, or indentation, or cut, or portion of reduced thickness, or any combination thereof, in the sheet of material.

A width of the first wall 104, in a direction perpendicular to the first direction, is greater at a first distal edge 126 of the first wall 104 than at the first edge 105 of the base 102. Specifically, in this embodiment, a width of the first wall 104 increases in the first direction.

A width of the second wall 106, in a direction perpendicular to the second direction, is greater at a second distal edge 128 of the second wall 106 than at the second edge 107 of the base 102. Specifically, in this embodiment, a width of the second wall 106 increases in the second direction.

A width of the third wall 108, in a direction perpendicular to the third direction, is greater at a third distal edge 130 of the third wall 108 than at the third edge 109 of the base 102. Specifically, in this embodiment, a width of the third wall 108 increases in the third direction.

A width of the fourth wall 110, in a direction perpendicular to the fourth direction, is greater at a fourth distal edge 132 of the fourth wall 110 than at the fourth edge 111 of the base 102. Specifically, in this embodiment, a width of the fourth wall 110 increases in the fourth direction.

Each of the walls 104, 106, 108, 110 may therefore be considered a tapered wall, i.e., a wall the width of which tapers outwardly in a direction away from the base 102. In some embodiments, the thermally insulative liner 100 may be considered to have the shape of a Maltese cross.

In this embodiment, a length of the base 102 in the direction D is approximately 22 cm. In other embodiments, however, the length of the base 102 is a different length, for example between 21 cm and 23 cm, or between 20 cm and 24 cm, or between 19 cm and 25 cm, or between 18 cm and 26 cm, or between 17 cm and 27 cm, or between 15 cm and 30 cm, or between 10 cm and 35 cm, or between 5 cm and 50 cm, or greater than or equal to 50 cm, or less than or equal to 5 cm.

In this embodiment, a width of the base 102 perpendicular to the direction D is approximately 26.5 cm. In other embodiments, however, the width of the base 102 is a different width, for example between 25 cm and 28 cm, or between 24 cm and 29 cm, or between 23 cm and 30 cm, or between 22 cm and 31 cm, or between 21 cm and 32 cm, or between 20 cm and 33 cm, or between 15 cm and 35 cm, or between 10 cm and 40 cm, or between 5 cm and 50 cm, or greater than or equal to 50 cm, or less than or equal to 5 cm.

In this embodiment, a thickness of the base 102 in a direction perpendicular to the length and the width is approximately 0.5 cm. In other embodiments, however, the thickness of the base 102 is a different thickness, for example between 0.4 cm and 0.6 cm, or between 0.3 cm and 0.7 cm, or between 0.2 cm and 0.8 cm, or between 0.1 cm and 1 cm, or greater than or equal to 1 cm, or less than or equal 0.1 cm.

In this embodiment, the base 102 is substantially rectangular or square in shape. In other embodiments, however, the base 102 may be another shape.

In this embodiment, a length of each of the walls 104, 106, 108, 110, in a direction from the base 102 to the respective distal edge 126, 128, 130, 132, is approximately 17 cm. In other embodiments, however, the length of one or more of the walls 104, 106, 108, 110 is a different length, for example between 16 cm and 18 cm, or between 15 cm and 19 cm, or between 14 cm and 20 cm, 13 cm and 21 cm, or between 13 cm and 22 cm, or between 12 cm and 23 cm, or between 11 cm and 24 cm, or between 10 cm and 25 cm, or between 5 cm and 50 cm, or greater than or equal to 50 cm, or less than or equal to 5 cm.

In this embodiment, a width of each of the first wall 104 and the second wall 106, in a direction perpendicular to its length, at the respective distal end 126, 128, is approximately 23 cm. A width of each of the third wall 108 and the fourth wall 110, in a direction perpendicular to its length, at the respective distal end 130, 132, is approximately 27.5 cm. In other embodiments, however, the width of one or more of the walls 104, 106, 108, 110 at the respective distal end 126, 128, 130, 132 is a different value, for example between 24 cm and 25 cm, or between 23 cm and 26 cm, or between 22 cm and 27 cm, or between 21 cm and 28 cm, or between 20 cm and 29 cm, or between 19 cm and 30 cm, or between 15 cm and 35 cm, or between 10 cm and 40 cm, or between 5 cm and 50 cm, or greater than or equal to 50 cm, or less than or equal to 5 cm.

In this embodiment, a width of each of the first wall 104 and the second wall 106, in a direction perpendicular to its length, at the respective crease 105, 107, is approximately 21 cm. A width of each of the third wall 108 and the fourth wall 110, in a direction perpendicular to its length, at the respective crease 109, 111, is approximately 25.5 cm. In other embodiments, however, the width of one or more of the walls 104, 106, 108, 110 at the respective crease 105, 107, 109, 111 is a different value, for example between 21 cm and 26 cm, or between 20 cm and 27 cm, or between 19 cm and 28 cm, or between 18 cm and 29 cm, or between 18 cm and 29 cm, or between 17 cm and 30 cm, or between 15 cm and 35 cm, or between 10 cm and 40 cm, or between 5 cm and 50 cm, or greater than or equal to 50 cm, or less than or equal to 5 cm.

In this embodiment, a thickness of each of the walls 104, 106, 108, 110 is approximately equal to the thickness of the base 102, i.e., the sheet of material of the liner has a uniform thickness. In other embodiments, however, a thickness of one or more of the walls 104, 106, 108, 110 is different from the thickness of the base 102.

Figure 2:
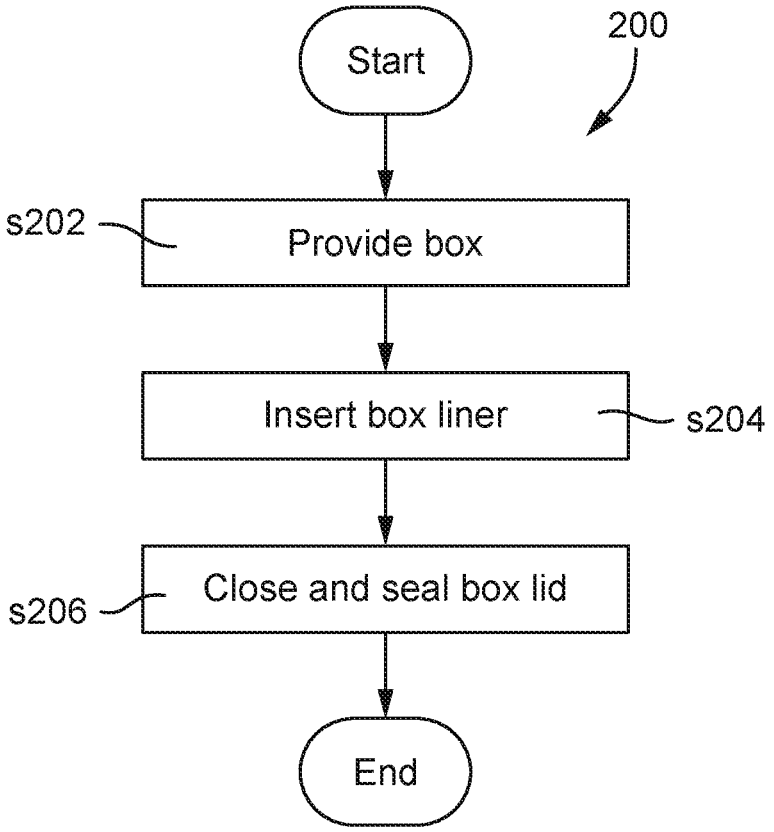
FIG. 2 is a process flow chart showing certain steps of a process for assembling the thermally insulative liner in a box.

FIG. 2 is a process (e.g., method) flow chart showing certain steps of a process 200 for assembling the thermally insulative liner 100 in a box.

At step s202, a box is provided.

At step s204, the thermally insulative liner 100 is inserted into the box.

Figure 3:
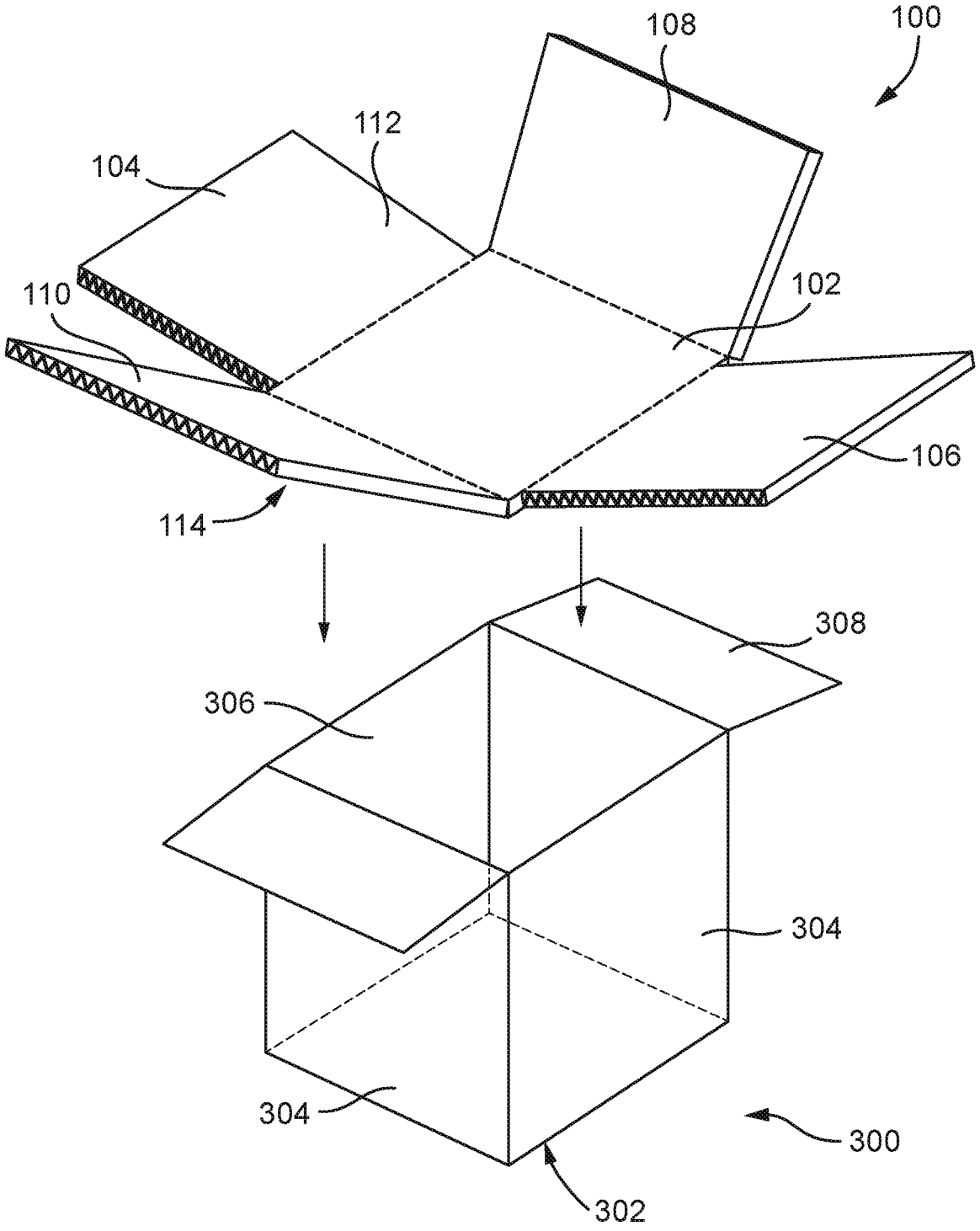
FIG. 3 is an exploded perspective view showing insertion of the thermally insulative liner into the box.

FIG. 3 is an exploded perspective view showing insertion of the thermally insulative liner 100 into the box 300 (e.g., into an internal volume of the box so that the thermally insulative liner is located within the internal volume), i.e., during execution of step s204.

The thermally insulative liner 100 is moved towards the box 300, as indicated by arrows in FIG. 3. The thermally insulative liner 100 is oriented such that the second surface 114 faces downwards towards the box 300, and the first surface 112 faces an upward direction.

The box 300 comprises a base 302 and sidewalls 304. The sidewalls 304 extend from the base 302. The sidewalls define an opening 306 (e.g., with an internal volume) opposite to the base 302. The box 300 further comprises closing flaps 308 at the ends of the sidewalls 304 opposite the base 302.

At step s204, the thermally insulative liner 100 is inserted into the box 300 via the opening 306. During insertion into the box 300, the walls 104, 106, 108, 110 contact the sidewalls 304. The walls 104, 106, 108, 110 are, through abutment with the sidewalls 304, made to rotate in the respective rotation directions described above.

Figure 4:
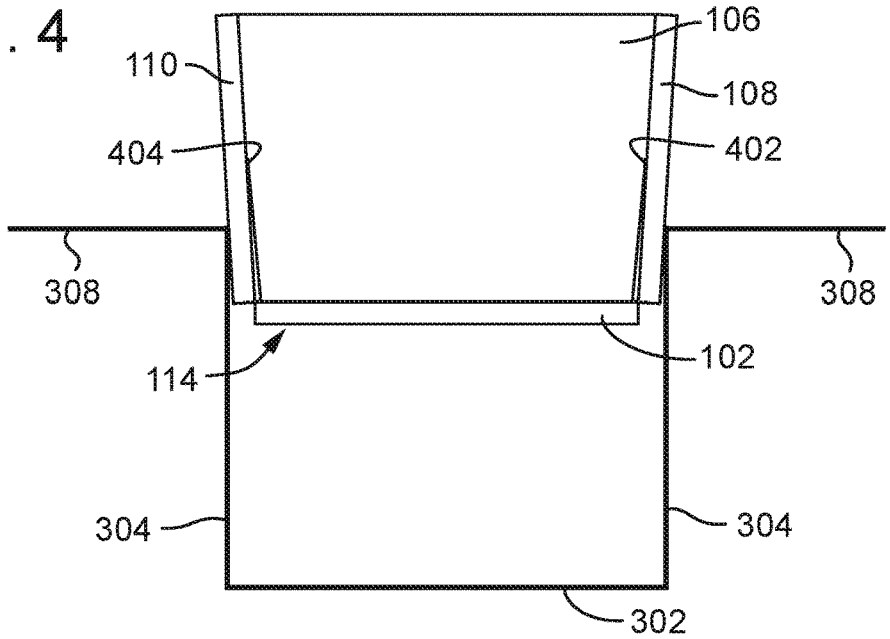
FIG. 4 is a schematic illustration (not to scale) of a side view cross section of a partially folded configuration of the thermally insulative liner during insertion into the box.

FIG. 4 is a schematic illustration (not to scale) of a side view cross section of a partially folded configuration of the thermally insulative liner 100 during insertion into the box 300, i.e., during execution of step s204. FIG. 4 shows the walls 104, 106, 108 during their rotation, the base 102 having passed through the opening 306.

As shown in FIG. 1, there exist respective non-zero distances 123, 125 from the transverse creases in the third and fourth walls 108, 110 to the base 102. Also, a width of each wall 104, 106, 108, 110 is less at the respective edge of the base 102 than at the respective distal edge of the wall. Consequently, in the partially folded configuration, there exist gaps, proximate the base 102, between neighbouring arms. Each gap defines a respective volume of air.

Advantageously, the taper in each of the walls 104, 106, 108, 110 tends to increase ease of insertion of the thermally insulative liner 100 into the box 300, while ensuring a tight or close, i.e., secure, fit with the box 300 once in a folded configuration. Thus, the thermally insulative liner may be inserted into the box 300 by a machine, e.g., on an assembly line.

Each of the gaps is largest at the base 102. By virtue of the taper in each of the walls 104, 106, 108, 110, each gap decreases in width in a direction from the base towards the distal end of the respective walls 104, 106, 108, 110. For each pair of neighbouring walls, there is defined a respective first contact point therebetween. At each first contact point, the respective walls contact, i.e., the width of the respective gap becomes zero. Each first contact point is located between the base 302 and the respective distal ends of the walls. Between the first contact point and the respective distal ends of the walls 104, 106, 108, 110, the width of the respective gap is zero. For clarity, the first contact point 402 between the second wall 106 and the third wall 108 in the partially folded configuration is indicated in FIG. 4. For clarity, the first contact point 404 between the second wall 106 and the fourth wall 110 in the partially folded configuration is indicated in FIG. 4.

The plurality of channels or cavities of the first wall 104 and the second wall 106 extend substantially parallel with the base 102 of the thermally insulative liner 100, i.e., approximately horizontally. Accordingly, the plurality of channels or cavities of the first wall 104 and the second wall 106 are hereinafter referred to as "horizontal channels".

In the partially folded configuration, at least some of the horizontal channels are closed by contact at each end with the third wall 108 and the fourth wall 110. Only those horizontal channels of the first wall 104 and the second wall 106 that are above (i.e., further from the base 102 than) (e.g., a top end of the second wall or the third wall is an end furthest from the base) the corresponding first contact points 402, 404 are closed at each end. Closure of the horizontal channels at each end may be further facilitated by a partial crumpling or crushing of respective parts of the first wall 104 or second wall 106. Specifically, respective parts of the first wall 104 or second wall 106 may partially crumple or deform, proximate points of contact with the third wall 108 and fourth wall 110, due to pressure from the third wall 108 and fourth wall 110. The horizontal channels are thereby closed. The entrance or exit of air from horizontal channels that are closed at each end is inhibited. The sum of volumes of those horizontal channels that are closed at each end defines a total enclosed horizontal channel volume.

As movement of the base 102 of the thermally insulative liner 100 continues towards the base 302 of the box 300, the walls 104, 106, 108, 110 are increasingly confined by the sidewalls 304. Thus, the walls 104, 106, 108, 110 continue to rotate in their respective rotation directions.

Figure 5:
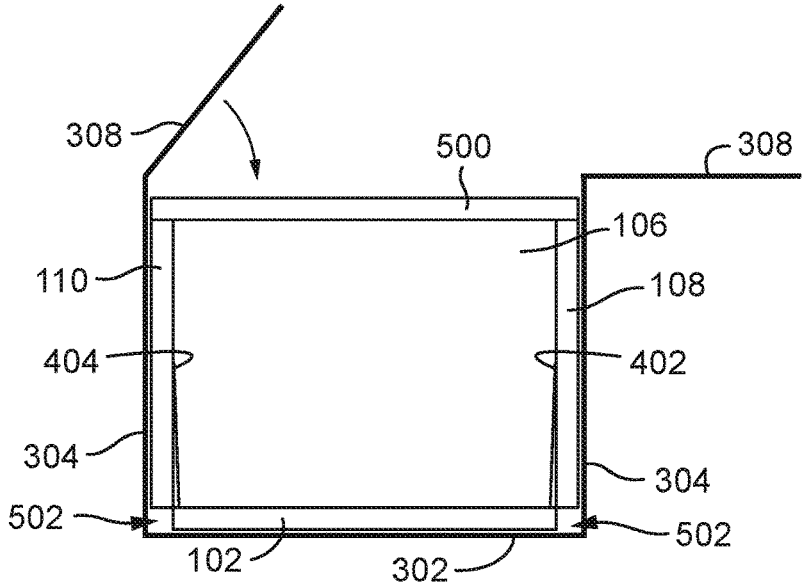
FIG. 5 is a schematic illustration (not to scale) of a side view cross section of a folded configuration of the thermally insulative liner following insertion into the box.

FIG. 5 is a schematic illustration (not to scale) of a side view cross section of a folded configuration of the thermally insulative liner 100 following insertion into the box 300, i.e., following execution of step s204.

In the folded configuration, the base 102 of the thermally insulative liner 100 abuts, and lies substantially flush with, the base 302 of the box 300. The walls 104, 106, 108, 110 are entirely confined by the sidewalls 304.

When the base 102 is inserted into the box 300, the walls 104, 106, 108, 110 are forced by respective sidewalls 304 to impinge upon the first surface 112 of the base 102. This impingement is facilitated by a partial crumpling or crushing of the thermally insulative liner 100 proximate the respective transverse crease. Thus, each of the first contact points 402, 404 is closer to the base 102 in the folded configuration than in the partially folded configuration. For clarity, the first contact point between the second wall 106 and the third wall 108 in the folded configuration is indicated by the reference numeral 402 in FIG. 5. For clarity, the first contact point between the second wall 106 and the fourth wall 110 in the folded configuration is indicated by the reference numeral 404 in FIG. 5.

The number of horizontal channels of each of the first wall 104 and the second wall 106 that are closed at each end is therefore greater in the folded configuration than in the partially folded configuration. The enclosed horizontal channel volume in the folded configuration is greater than that of the partially folded configuration. Advantageously, this tends to reduce the rate of heat transfer across the first and second walls 104, 106. Thus, the thermally insulative liner 100 tends to provide for improved thermal insulation of the packaging. It is particularly advantageous that any horizontal channel that is not closed at each end are situated proximate the base 102, and not proximate the distal ends of the respective walls. Thus, a thermally insulating effect tends to be most improved proximate the opening 306 of the box 300. Because warm air rises, the thermal insulation of packaging for hot goods (e.g., food) tends to be particularly improved.

Optionally, the process 200 may further include, before execution of step s206, inserting goods to be packaged into the liner. Specifically, goods may be inserted through an opening of the folded liner opposite the base 102.

In this embodiment, inserting the box liner at step s204 includes covering the opening of the folded liner with a liner cover 500. As is shown in FIG. 5, the liner cover 500 rests atop respective top ends of the walls 104, 106, 108, 110. The liner cover 500 extends across the opening 306. When the liner is in the folded configuration and the liner cover 500 provided, there is defined an enclosed volume (also called an internal volume) between the thermally insulative liner 100 and the liner cover 500. Goods added during the process 200 are enclosed within the enclosed volume.

Optionally, the liner cover 500 may subsequently be secured to the thermally insulative liner 100 by any appropriate fastening means. The fastening means may be integral with the liner cover 500, and/or the thermally insulative liner 100, and/or the box 300, or may be an entirely separate fastening means. In this embodiment, the liner cover 500 is secured against the thermally insulative liner 100 by sections of the box 300 that fold inwards to press against the liner cover 500 and force it against the thermally insulative liner 100. In other embodiments, however, the fastening means may be a different type of fastening means, for example an adhesive, one or more pins, or a plurality of tabs and slots for receiving said tabs.

The plurality of channels or cavities of the third wall 108 and the fourth wall 110 extend substantially in a direction from the base 302 to the opening 306 of the box 300, i.e., approximately vertically. Accordingly, the plurality of channels or cavities of the first wall 104 and the second wall 106 are hereinafter referred to as "vertical channels".

In this embodiment, the vertical channels of the third wall 108 and the fourth wall 110 are closed at respective top ends by contact with the liner cover 500. The entrance or exit of air from vertical channels or cavities that are closed at respective top ends is inhibited. Advantageously, this tends to reduce the rate of heat transfer across the third and fourth walls 108, 110. Thus, the thermally insulative liner 100 tends to provide for improved thermal insulation of the packaging.

In the folded configuration, there is defined, at each corner of the box 300, a void 502 between the respective pair of neighbouring walls and the base 102. Advantageously, the voids 502 trap air therewithin. This tends to reduce a rate of heat transfer between the enclosed volume of the thermally insulative liner 100 and the exterior of the box 300.

Referring again to FIG. 2, at step s206 the box 300 is closed and sealed. In this embodiment, closing and sealing the box includes closing the closing flaps 308 of the box 300. Movement of one of the closing flaps 308 towards the base 302 of the box 300, i.e., closure of the closing flap 308, is indicated by an arrow in FIG. 5 and may be accomplished manually, e.g., by a packager.

Figure 6:
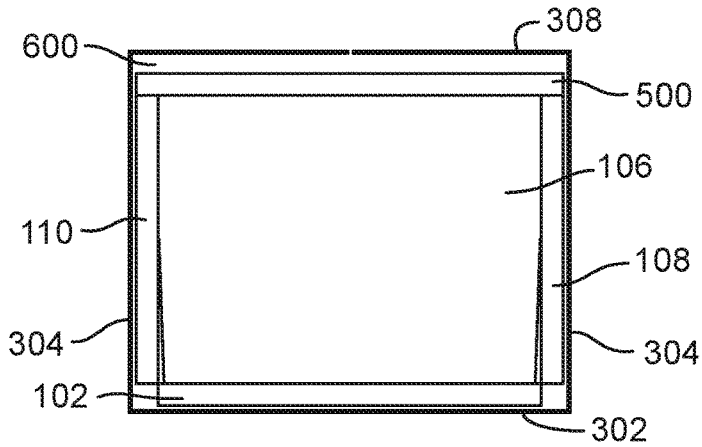
FIG. 6 is a schematic illustration (not to scale) of a side view cross section of a folded configuration of the thermally insulative liner following insertion into and closure of the box.

FIG. 6 is a schematic illustration (not to scale) of a side view cross section of the second configuration of the thermally insulative liner 100 following insertion into and closure of the box 300. The closing flaps 308 have been aligned (e.g., to meet) and sealed together, thereby to form a unitary box lid.

In this embodiment, the liner cover 500 closes the vertical channels of the third wall 108 and the fourth wall 110. There is defined a cavity 600 between the box lid formed by the flaps 308 and the liner cover 500. This cavity 600 may provide additional storage space for goods, or a thermally insulative region of air. In other embodiments, however, no liner cover 500 is provided. Instead, the flaps 308, when closed to form the unitary box lid, contact the distal ends of the walls 104, 106, 108, 110. In these other embodiments, at least some of the vertical channels are closed at respective top ends by contact with the unitary box lid. The entrance or exit of air from vertical channels or cavities that are closed at respective top ends is inhibited. Advantageously, this tends to reduce the rate of heat transfer across the third and fourth walls 108, 110. Thus, the thermally insulative liner 100 tends to provide for improved thermal insulation of the packaging.

Figure 7:
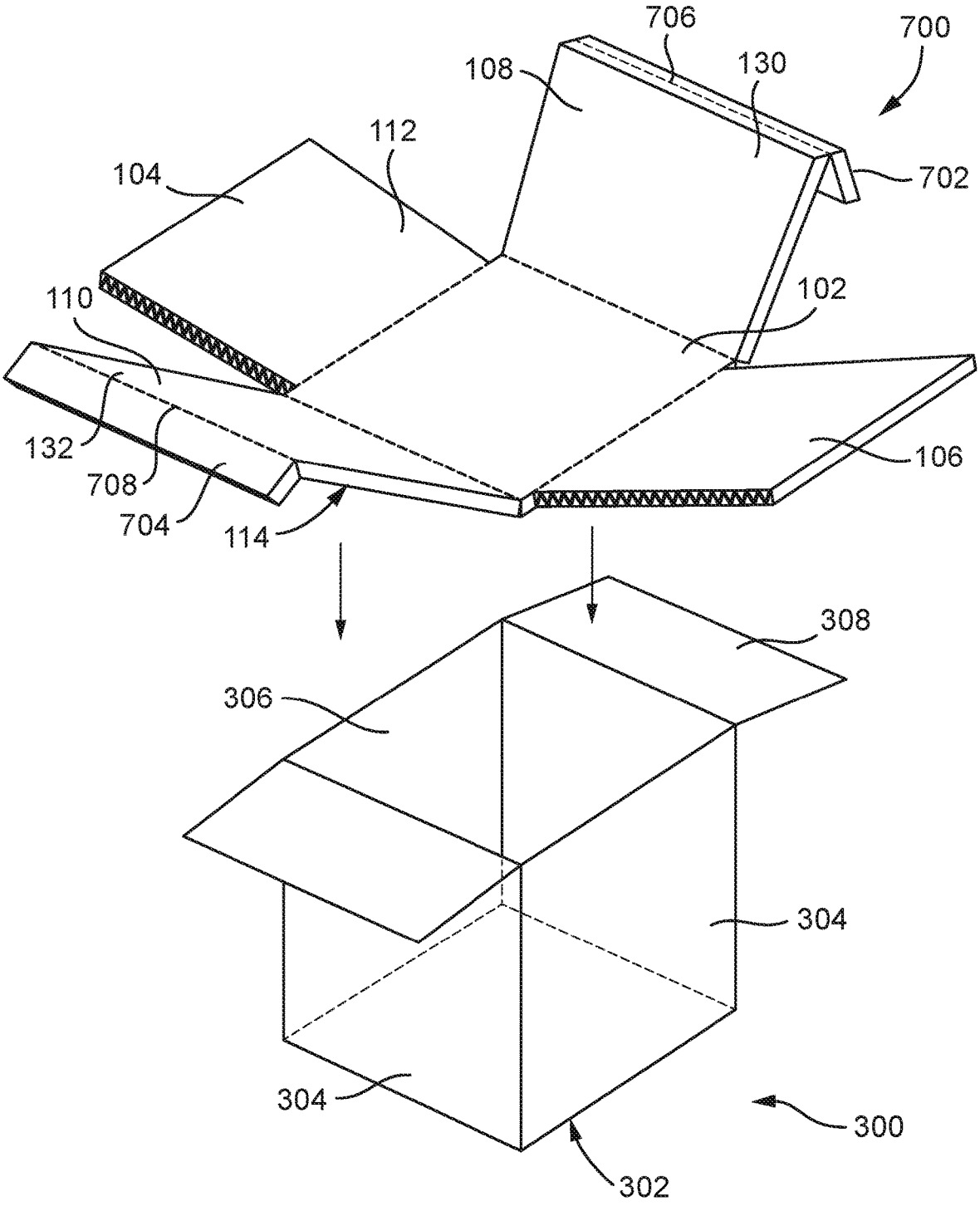
FIG. 7 is an exploded perspective view showing insertion of a further thermally insulative liner into the box.

FIG. 7 is a schematic illustration (not to scale) showing insertion of a further embodiment of the thermally insulative liner (hereinafter referred to as the "further thermally insulative liner 700") into the box 300.

In this embodiment, the further thermally insulative liner 700 comprises the elements of the thermally insulative liner 100 described in more detail earlier above with reference to FIG. 1. In addition, the further thermally insulative liner 700 comprises a third end segment 702 and a fourth end segment 704.

The third end segment 702 extends from the third distal edge 130 of the third wall 108. A first further crease 706 (indicated by a dotted line in FIG. 7) separates the third end segment 702 from the third wall 108. The third end segment 702 may rotate relative to the third wall 108 about the first further crease 706.

The fourth end segment 704 extends from the fourth distal edge 132 of the fourth wall 110. A second further crease 708 (indicated by a dotted line in FIG. 7) separates the fourth end segment 704 from the fourth wall 110. The fourth end segment 704 may rotate relative to the fourth wall 110 about the second further crease 708.

In this embodiment, the dimensions of the thermally insulative liner 100 are in accordance with the above embodiment. In other embodiments, one or more dimensions of the thermally insulative liner 100 are different to that/those of the above embodiment.

In this embodiment, a length of each of the third end segment 702 and the fourth end segment 704, in a direction perpendicular to the respective crease 706, 708, is approximately 5 cm. In other embodiments, however, the length of each of the third end segment 702 and the fourth end segment 704 is a different length, for example between 4 cm and 5 cm, or between 3 cm and 6 cm, or between 2 cm and 7 cm, or between 1 cm and 8 cm, or greater than or equal to 8 cm, or less than or equal to 1 cm. In other embodiments, the length of the third end segment 702 is different to that of the fourth end segment 704.

In this embodiment, the width of each of the third wall 108 and the fourth wall 110 at the respective distal end 130, 132 is approximately equal to a width of the respective end segment 702, 704. In other embodiments, however, the width of the respective end segment 702, 704 is greater than the width of each of the third wall 108 and the fourth wall 110 at the respective distal end 130, 132. In some embodiments, the width of one or more of the end segments 702, 704 may change in the direction of its length, i.e., one or more of the end segments 702, 704 may be tapered.

The process 200 of FIG. 2 may be applied to the further thermally insulative liner 700, thereby to insert the further thermally insulative liner 700 into the box 300. During execution of step s204, the further thermally insulative liner 700 is moved towards the box 300, as indicated by arrows in FIG. 7.

Figure 8:
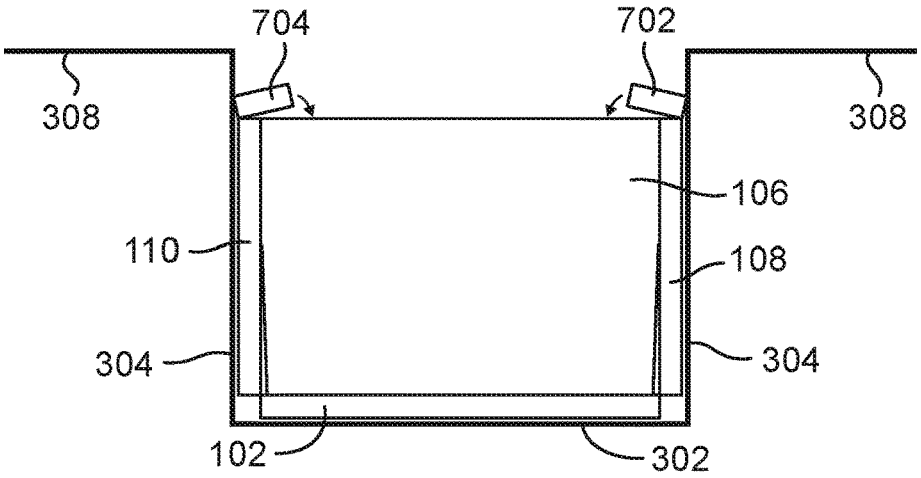
FIG. 8 is a schematic illustration (not to scale) of a side view cross section of a further configuration of the further thermally insulative liner following insertion into the box.

FIG. 8 is a schematic illustration (not to scale) of a side view cross section of the further thermally insulative liner 700 following its insertion into the box 300, i.e., following execution of step s204.

In this embodiment, the vertical channels of the third wall 108 and the fourth wall 110 may be closed at respective top ends by contact with, respectively, the third end segment 702 and the fourth end segment 704.

FIG. 8 illustrates the way in which closure of the vertical channels of the third wall 108 and the fourth wall 110 is achieved. The third end segment 702 (e.g., closing segment) and the fourth end segment 704 (e.g., further closing segment) may each be rotated inwards away from a respective nearest sidewall 304 (e.g., a rotatably attached to a wall) and towards the base 302 of the box 300. Movement of the third end segment 702 and the fourth end segment 704 is indicated by arrows in FIG. 8 and may be accomplished manually, e.g., by a packager. The third end segment 702 (e.g., closing segment) and the fourth end segment 704 (e.g., further closing segment) may each be configured to extend across, and meet within, the opening, thereby to together form the cover defining the enclosed volume between the cover, the base, and the plurality of sidewalls.

Figure 9:
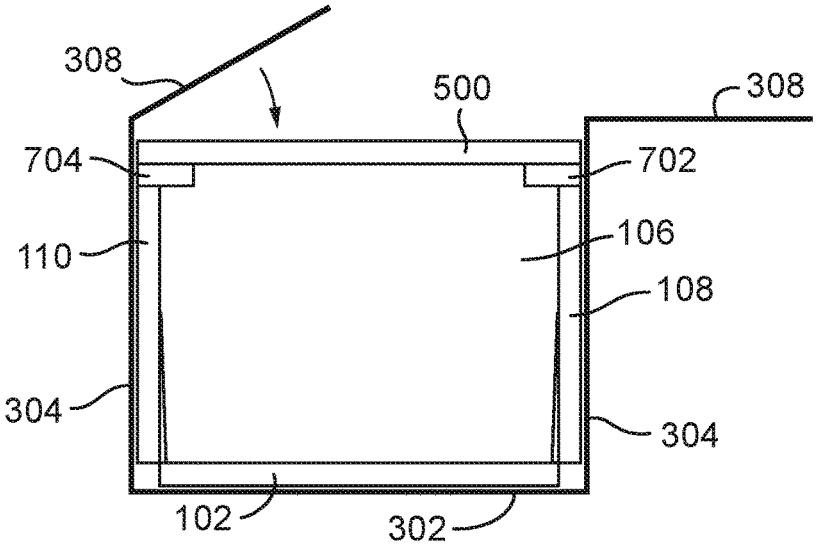
FIG. 9 is a schematic illustration (not to scale) of a side view cross section of a further folded configuration of the further thermally insulative liner following insertion into the box.

FIG. 9 is a schematic illustration (not to scale) of a side view cross section of the further thermally insulative liner 700 following insertion into the box 300. FIG. 9 shows the further thermally insulative liner 700 and box 300 during execution of step s206.

The folded configuration of the further thermally insulative liner 700 is analogous with the folded configuration of the previous embodiment of the thermally insulative liner 100.

However, in this embodiment, the vertical channels of the third wall 108 and the fourth wall 110 are closed at respective top ends by contact with, respectively, the third end segment 702 and the fourth end segment 704. The entrance or exit of air from vertical channels that are closed at respective top ends is inhibited. Advantageously, this tends to reduce the rate of heat transfer across the third and fourth walls 108, 110. Thus, the thermally insulative liner 100 tends to provide for improved thermal insulation of the packaging.

In this embodiment, inserting the box liner at step s204 may include covering the opening of the folded liner with the liner cover 500. The liner cover 500 rests atop the third end segment 702 and the fourth end segment 704. The liner cover 500 extends across the opening 306. The enclosed volume of the liner is defined between the thermally insulative liner 100 and the liner cover 500.

Closure of one of the closing flaps 308, e.g., at step s206, to form the unitary box lid is indicated by an arrow in FIG. 9 and may be accomplished manually, e.g., by a packager.

Figure 10:
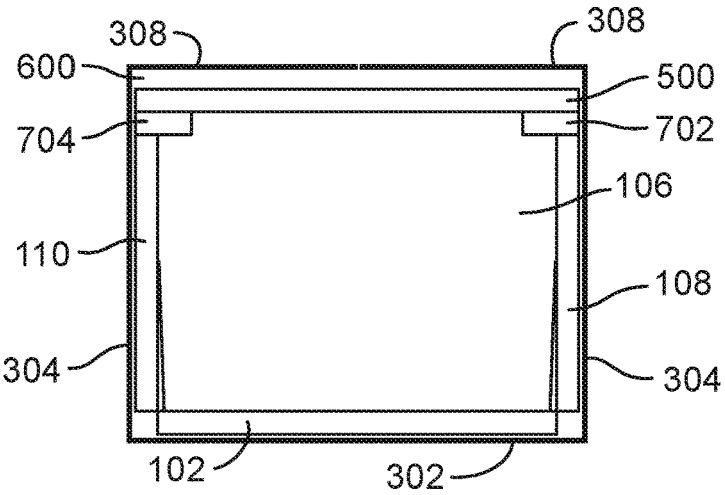
FIG. 10 is a schematic illustration (not to scale) of a side view cross section of the further folded configuration of the further thermally insulative liner following insertion into and closure of the box.

FIG. 10 is a schematic illustration (not to scale) of a side view cross section of the further thermally insulative liner 700 inside the closed box 300. FIG. 10 shows the further thermally insulative liner 700 and box 300 following execution of step s206.

In this embodiment, a length of each of the third end segment 702 and the fourth end segment 704 is less than half a width of the box at the opening 306, i.e., less than half the separation of opposing sidewalls at the opening 306. The liner is closed by the liner cover 500. The cavity 600 between the unitary box lid and the thermally insulative liner 100 may provide additional storage space for goods or a thermally insulative region of air.

In other embodiments, the unitary box lid may be supported through contact with each of the third end segment 702 and the fourth end segment 704. Advantageously, this tends to provide increased strength to the unitary box lid of the box 300. In particular, multiple boxes may be stacked without damage to each box 300 and the thermally insulative liner 100 and goods therein. The risk of spillages or breakages due to inverting, jostling, or otherwise mishandling the box during assembly or transit also tends to be reduced.

Also, a want for the box or other outer packaging of the packaging to be particularly robust or reinforced tends to be reduced. This tends to reduce manufacturing costs of the box or other outer packaging.

However, in other embodiments, the sum of the lengths of the third end segment 702 and the fourth end segment 704 is substantially equal to the width of the box at the opening 306. In these other embodiments, the third end segment 702 and fourth end segment 704 together form an integral liner cover. In these other embodiments, the integral liner cover fully extends across the opening 306 in place of the liner cover 500. This tends to provide further increased strength to the unitary box lid of the box 300, in particular allowing separate boxes to be stacked without damage to the box 300 and the further thermally insulative liner 700 and goods therein. The risk of spillages or breakages due to inverting, jostling, or otherwise mishandling the box during assembly or transit also tends to be further reduced. Also, a want for the box or other outer packaging of the packaging to be particularly robust or reinforced tends to be further reduced. This tends to reduce manufacturing costs of the box or other outer packaging.

In still other embodiments, the integral liner cover may be formed by only one of the third end segment 702 and the fourth end segment 704.

Figure 11:
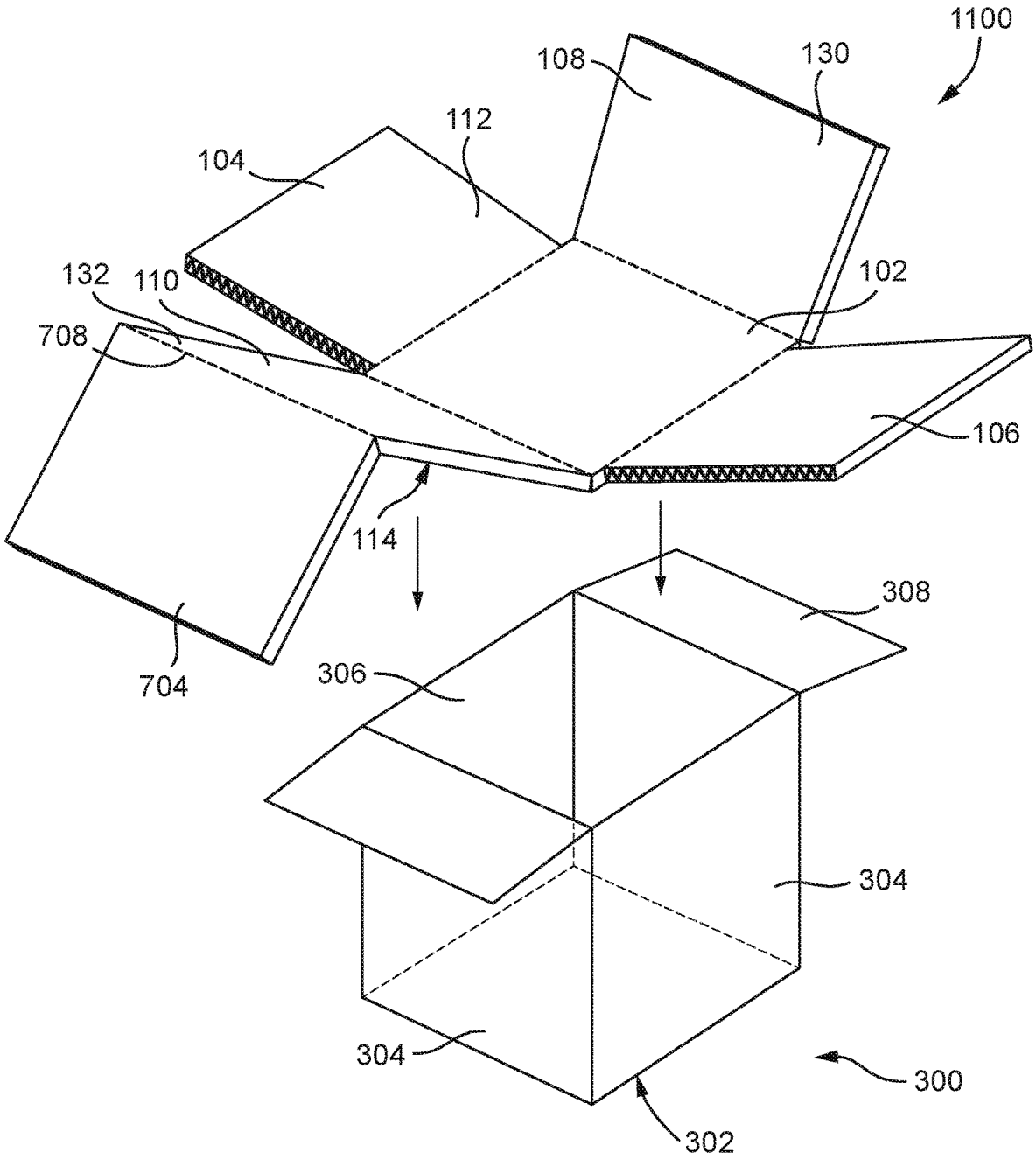
FIG. 11 is an exploded perspective view showing insertion of a yet further thermally insulative liner into the box.

One such embodiment is shown in FIG. 11, which is an exploded perspective view showing insertion of a yet further embodiment of the thermally insulative liner (hereinafter referred to as the "second further thermally insulative liner 1100") into the box 300.

In this embodiment, the second further thermally insulative liner 1100 does not comprise a third end segment 702. The second further thermally insulative liner 1100 comprises a fourth end segment 704. The fourth end segment 704 extends from the fourth distal edge 132 of the fourth wall 110. The second further crease 708 (shown by a dotted line in FIG. 11) separates the fourth end segment 704 from the fourth wall 110. The fourth end segment 704 may rotate relative to the fourth wall 110 about the second further crease 708.

In this embodiment, the length of the fourth end segment 704 is greater than in the further thermally insulative liner 700 shown in FIG. 7. Specifically, in this embodiment, the length of the fourth end segment 704 is greater than half the width of the box 300 at the opening 306. More specifically, the length of the fourth end segment 704 is approximately equal to the width of the box 300 proximate the opening 306.

In this embodiment, the dimensions of the second further thermally insulative liner 1100 are in accordance with the above embodiments, where applicable. In other embodiments, one or more dimensions of the second further thermally insulative liner 1100 are different to that/those of the above embodiments.

In this embodiment, the length of the fourth end segment 704 is approximately 23 cm. In other embodiments, however, the length of the fourth end segment 704 is a different length, for example between 22 cm and 24 cm, or between 21 cm and 25 cm, or between 20 cm and 26 cm, or between 19 cm and 27 cm, or between 18 cm and 28 cm, or between 17 cm and 29 cm, or between 17 cm and 30 cm, or between 15 cm and 35 cm, or between 10 cm and 40 cm, or between 5 cm and 50 cm, or greater than or equal to 50 cm, or less than or equal to 5 cm.

In this embodiment, the width of the fourth wall 110 at the fourth distal end 132 is approximately equal to a width of the fourth end segment 704. In other embodiments, however, the width of the fourth end segment 704 is greater than the width of the fourth wall 110 at the fourth distal end 132. In some embodiments, the width of the fourth end segment 704 may change in the direction of its length, i.e., the fourth end segment 704 may be tapered.

The process 200 of FIG. 2 may be applied the second further thermally insulative liner 1100, thereby to insert the second further thermally insulative liner 1100 into the box 300.

During execution of step s204, the second further thermally insulative liner 1100 of this embodiment is moved towards the box 300, as indicated by arrows in FIG. 11.

Figure 12:
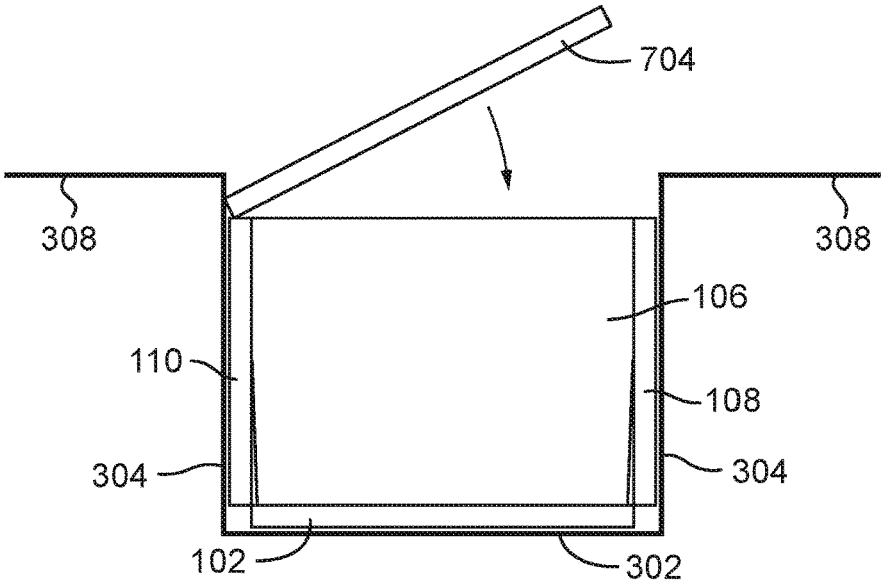
FIG. 12 is a schematic illustration (not to scale) of a side view cross section of a yet further configuration of the yet further thermally insulative liner following insertion into the box.

FIG. 12 is a schematic illustration (not to scale) of a side view cross section of the second further thermally insulative liner 1100 following insertion into the box 300, i.e., following execution of step s204.

In this embodiment, the plurality of channels or cavities of the third arm 108 and the fourth arm 110 may be closed at respective top ends by contact with the fourth end segment 704.

FIG. 12 illustrates the way in which closure of the vertical channels of the third wall 108 and the fourth wall 110 is achieved. The fourth end segment 704 may be moved, i.e., rotated, away from the nearest sidewall 304 and towards the base 302 of the box 300. Movement of the fourth end segment 704 is indicated by an arrow in FIG. 12 and may be accomplished manually, e.g., by a packager.

However, in this embodiment, movement of the fourth end segment 704 may alternatively be accomplished through rotation of, and contact with, one or both of the closing flaps 308.

Figure 13:
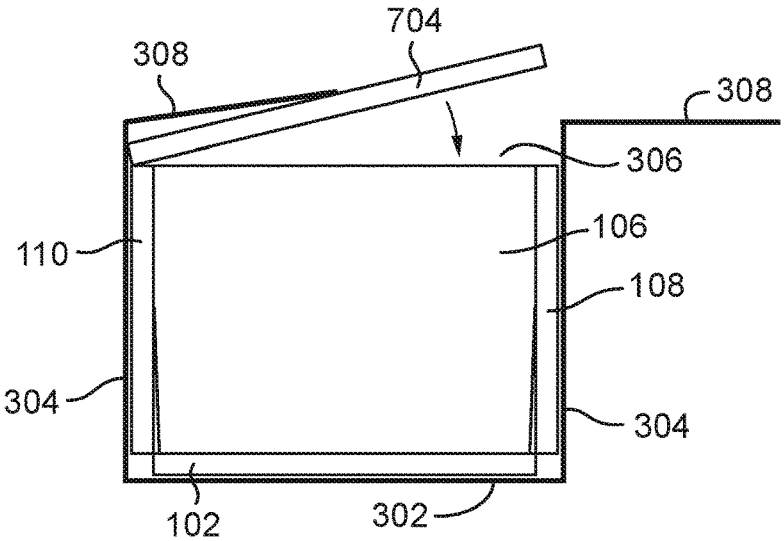
FIG. 13 is a schematic illustration (not to scale) of a side view cross section of a yet further folded configuration of the yet further thermally insulative liner following insertion into the box.

FIG. 13 is a schematic illustration (not to scale) of a side view cross section of the second further thermally insulative liner 1100 following insertion into the box 300, i.e., following execution of step s204. FIG. 13 shows the second further thermally insulative liner 1100 and box 300 during execution of step s206.

Movement of the fourth end segment 704 by rotation of the closing flap 308 is indicated by an arrow in FIG. 13 and may be accomplished manually, e.g., by a packager.

Figure 14:
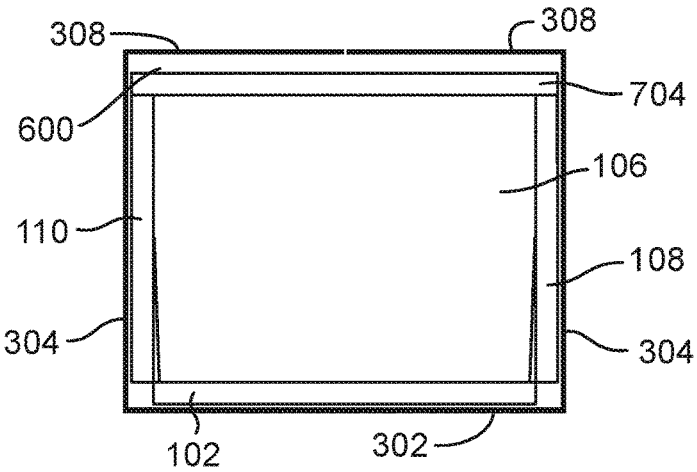
FIG. 14 is a schematic illustration (not to scale) of a side view cross section of the yet further folded configuration of the yet further thermally insulative liner following insertion into and closure of the box.

FIG. 14 is a schematic illustration (not to scale) of a side view cross section of the second further thermally insulative liner 1100 following insertion into and closure of the box 300. FIG. 14 shows the second further thermally insulative liner 1100 and box 300 following execution of step s206. The closing flaps 308 have been aligned and sealed together, thereby to form the unitary box lid.

The folded configuration of this embodiment of the second further thermally insulative liner 1100 is analogous to the folded configuration of the above embodiments of the thermally insulative liner 100 and further thermally insulative liner 700.

However, in this embodiment, the vertical channels of the third wall 108 and the fourth wall 110 are closed at respective top ends by contact with the fourth end segment 704. The entrance or exit of air from vertical channels which are closed at respective top ends is inhibited. Advantageously, this tends to reduce the rate of heat transfer across the third and fourth arms 108, 110. Thus, the second further thermally insulative liner 1100 tends to provide for improved thermal insulation of the packaging.

The fourth end segment 704 forms the integral liner cover that closes the liner thereby to define the enclosed volume.

As outlined above and illustrated in FIG. 13, the liner may adopt the closed, i.e., covered, position shown in FIG. 14 without being directly handled, e.g., by a packager. The second further thermally insulative liner 1100 may therefore be considered to operate in an at least partially auto-closing or auto-sealing manner. Thus, the risk of incorrect or incomplete closure of the packaging tends to be reduced. This tends to advantageously mitigate the risk of spillages, breakages, or undesirable cooling/heating of the packaged goods, at low effort and cost to the packager.

In this embodiment, the cavity 600 defined between the unitary box lid and the thermally insulative liner 100 may provide additional storage space for goods or improved thermal insulation. The fourth end segment 704 may provide a surface on which goods to be stored within the cavity may rest.

In other embodiments the unitary box lid is supported through contact with the fourth end segment 704. Advantageously, this tends to provide increased strength to the unitary box lid of the box 300. In particular, multiple boxes may be stacked without damage to the box 300 and the thermally insulative liner 100 and goods therein. The risk of spillages or breakages due to inverting, jostling, or otherwise mishandling the box during assembly or transit also tends to be reduced. Also, a want for the box or other outer packaging of the packaging to be particularly robust or reinforced tends to be reduced. This tends to reduce manufacturing costs of the box or other outer packaging.

Advantageously, in the above embodiments, the walls 104, 106, 108, 110 of the thermally insulative liner 100 tend to be assisted in remaining in their positions in the folded configuration by friction with the respective adjacent sidewalls 304 of the box 300. In some embodiments, the liner tends to be held in position within the box 300 solely by friction. This tends to facilitate the packing of goods and tends to be particularly beneficial for assembly line packing of goods.

In the above embodiment of the second further thermally insulative liner 1100, the fourth end segment 704 forms the integral liner cover and bounds the enclosed volume of the liner. Advantageously, the fourth end segment 704 tends to be assisted in remaining in its position by friction with respective top ends of the walls 104, 106, 108, 110. In some embodiments, the fourth end segment tends to be held in position atop the walls 104, 106, 108, 110 solely by friction. The risk of spillages or breakages due to inverting, jostling, or otherwise mishandling the box during assembly or transit therefore tends to be reduced. Also, a want for the box or other outer packaging of the packaging to be particularly robust or reinforced tends to be reduced. This tends to reduce manufacturing costs of the box or other outer packaging.

In the above embodiments, the liner is formed entirely of cellulose fibre material, e.g., cardboard. Preferably, the liner is made of corrugated cardboard. Advantageously, the liner therefore tends to be at least partially recyclable or made at least partially of recycled material. This tends to reduce a volume of waste packaging, and a volume of non-recyclable waste. Furthermore, when the liner is in its unfolded, i.e., flat, configuration, the plurality of channels or cavities through the core of the liner are substantially coplanar and parallel. This allows manufacture of the liner using preformed conventionally fluted or corrugated sheets. Alternatively, this material allows formation of the plurality of channels or cavities within a core of the sheet of material in-situ on the production line, e.g., before or during cutting or shaping of the liner. The cost and duration of manufacture of the liner thus tends to be reduced.

Manufacture, use, and re-use of the thermally insulative liner for packaging therefore tends to be energy-efficient and to minimise detrimental environmental impact.

In the above embodiments, the first surface 112 of the liner may be considered an inner surface of the liner when the liner is in its folded configuration. The second surface 114 of the liner may be considered an outer surface of the liner when the liner is in its folded configuration.

In the above embodiments, the plurality of channels or cavities formed by the fluted or corrugated sheet of the core may be considered to be sandwiched between the inner surface and the outer surface of the liner.

In the above embodiments, the walls 104, 106, 108, 110 of the liner form an opening opposite the base when the liner is in its folded configuration.

It should be noted that certain of the process steps depicted in the flowchart of FIG. 2 and described above may be omitted, or such process steps may be performed in differing order to that presented above and shown in FIG. 2. Furthermore, although all the process steps have, for convenience and ease of understanding, been depicted as discrete temporally-sequential steps, some of the process steps may nevertheless in fact be performed simultaneously or in a temporally-overlapping manner, at least to some extent.

In the above embodiments, the box is substantially cuboidal in shape when the closing flaps seal the opening. More specifically, in the above embodiments, the box comprises four sidewalls, a base, and a unitary box lid. However, in other embodiments, there may be a different number of sidewalls, for example three sidewalls, five sidewalls, six sidewalls, seven sidewalls, or eight sidewalls, thereby to define a non-cuboidal shape of the box.

In the above embodiments, the walls of the liner are tapered such that a width of each wall is, at least somewhere along the length of the wall, greater than the width of the corresponding edge of the base. This ensures that two walls of the liner close at least some of the horizontal channels in each of two other walls. However, in other embodiments, the walls of the liner are not tapered. For example, in some embodiments, the walls of the liner each have a uniform width along their length, said width being greater than a width of the corresponding edge of the base.

In the above embodiments, the box comprises substantially linear or straight sidewalls. However, in other embodiments, there may be a number of curved sidewalls, for example one continuous curved sidewall or two continuous curved sidewalls.

In the above embodiments, the liner defines a substantially cuboidal enclosed volume, upon assembly, in its folded configuration. However, in other embodiments, the liner is shaped to define an enclosed volume of a different shape.

In the above embodiments, the liner has the dimensions described above. However, in other embodiments, the liner may have one or more dimensions different from those described in the embodiments above.

In the above embodiments, a single liner is disposed within, i.e., lines, a box, thereby to form packaging. In other embodiments, however, more than one of the liners embodied above may line a box or other outer packaging, thereby to form packaging having further improved thermal insulation. For example, some packaging having further improved thermal insulation may comprise two liners or three liners.

In the above embodiments, the liner is formed of a sheet of material comprising a first surface, a second surface, and a core between the first surface and the second surface. The core comprises a fluted or corrugated sheet defining a plurality of channels or cavities. Use of conventionally fluted or corrugated sheets (e.g., corrugated cardboard sheets) tends to reduce the cost and duration of manufacture of the liner. In other embodiments, however, the core comprises another material or sheet that is ribbed, ridged, grooved, or channelled, or otherwise structured thereby to define a plurality of channels or cavities between the first and second surfaces.

In the above embodiments, the liner is formed of a single core between a first surface and second surface, i.e., a single layer of corrugated or fluted wall. In other embodiments, however, the liner is formed of multiple cores sandwiched between respective surfaces, thereby to define multiple layers of corrugated or fluted walls. For example, in other embodiments, each of the walls of the liner comprises two, or three, or four cores separated by respective surfaces, thereby to define double-, or triple-, quadruple-corrugated or fluted walls.

In the above embodiments, the thermally insulative liner is formed of cardboard. However, in other embodiments, the liner comprises one or more materials selected from the group of materials consisting of: a recycled material, a recyclable material, a biodegradable material, paper, card, cardboard, wood, polymer, and a cellulose fibre material.

In the above embodiments, the box lined by the liner comprises two closing flaps that, in some embodiments, assist in closing the cover of the liner, i.e., that help provide some auto-closing or auto-sealing character to the liner. However, in other embodiments, the box lined by the thermally insulative liner comprises a different number of closing flaps, for example one, three, or four. In other embodiments still, the box lined by the liner may have no closing flaps, and the unitary box lid may not be formed or may be formed by a lid or cover separate to the box.

The invention claimed is:

1. A thermally insulative liner for a box, the liner comprising:

a base; and a plurality of sidewalls, each sidewall extending from the base thereby to define an opening opposite the base; wherein each of the plurality of sidewalls comprises:

an inner surface;

an outer surface; and a plurality of channels formed between the inner surface and the outer surface and extending parallel with the inner surface and the outer surface;

a first sidewall of the plurality of sidewalls contacts two other sidewalls of the plurality of sidewalls;

a width of the first sidewall, at least somewhere along its length, is greater than a width of the first sidewall at the base;

one or more of the plurality of channels in the first sidewall is closed at opposing ends by the respective inner surfaces of the two other sidewalls; and each plurality of channels is formed by a fluted or corrugated sheet sandwiched between the respective inner surface and the respective outer surface.

2. The thermally insulative liner of claim 1, further comprising a cover extending across the opening, thereby to define an enclosed volume of the liner.

3. The thermally insulative liner of claim 2, wherein one or more of the plurality of channels in one or both of the two other sidewalls is closed at a top end by the cover, the top end being an end opposite the base.

4. The thermally insulative liner of claim 1, wherein the width of the first sidewall increases in a direction from the base to the opening.

5. The thermally insulative liner of claim 1, wherein:

the thermally insulative liner further comprises a closing segment rotatably attached to a second sidewall of the plurality of sidewalls at a top end of the second sidewall, the top end being an end of the second sidewall furthest from the base; and the closing segment is configured to close one or more of the plurality of channels in the second sidewall at the top end.

6. The thermally insulative liner of claim 5, wherein the second sidewall is one of the two other sidewalls.

7. The thermally insulative liner of claim 5, wherein the closing segment is further configured to close one or more of the plurality of channels in a third sidewall of the plurality of sidewalls.

8. The thermally insulative liner of claim 7, wherein the second sidewall is one of the two other sidewalls and the third sidewall is an opposite one of the two other sidewalls.

9. The thermally insulative liner of claim 7 further comprising a cover extending across the opening, thereby to define an enclosed volume of the liner, wherein the closing segment is configured to extend entirely across the opening, thereby to form the cover defining the enclosed volume between the cover, the base, and the plurality of sidewalls.

10. The thermally insulative liner of claim 5, wherein:

the thermally insulative liner further comprises a further closing segment rotatably attached to a third sidewall of the plurality of sidewalls at a top end of the third sidewall, the top end being an end of the third sidewall furthest from the base; and the further closing segment is configured to close one or more of the plurality of channels in the third sidewall at said top end of the third sidewall.

11. The thermally insulative liner of claim 10 further comprising a cover extending across the opening, thereby to define an enclosed volume of the liner, wherein the closing segment and the further closing segment are each configured to extend across, and meet within, the opening, thereby to together form the cover defining the enclosed volume between the cover, the base, and the plurality of sidewalls.

12. The thermally insulative liner of claim 1, wherein:

the plurality of channels of the first sidewall extends in a direction parallel to the base; and the plurality of channels of the two other sidewalls extend in a direction perpendicular to the base.

13. The thermally insulative liner of claim 1, wherein the liner comprises one or more materials selected from a group of materials consisting of: a recycled material, a recyclable material, a biodegradable material, paper, card, cardboard, corrugated cardboard, wood, polymer, and a cellulose fibre material.

14. Thermally insulative packaging, comprising:

outer packaging defining an internal volume; and a thermally insulative liner located within the internal volume of the outer packaging, the thermally insulative liner being in accordance with claim 1.

15. The thermally insulative packaging of claim 14, wherein:

the outer packaging is a box comprising:

a box base;

a plurality of box sidewalls extending from the base, the plurality of box sidewalls defining a box opening to the internal volume of the outer packaging, the box opening being opposite to the box base; and a box cover configured to cover the box opening.

16. The thermally insulative packaging of claim 15, wherein one or more of the plurality of channels in a sidewall of the plurality of sidewalls is closed at a top end of said sidewall by the box cover.

17. A method for assembling thermally insulative packaging, the method comprising:

providing outer packaging, the outer packaging defining an internal volume; and inserting a thermally insulative liner into the internal volume of the outer packaging, the thermally insulative liner in accordance with claim 1.

18. A thermally insulative liner for a box, the liner comprising:

a base; and a plurality of sidewalls, each sidewall extending from the base thereby to define an opening opposite the base; wherein each of the plurality of sidewalls comprises:

an inner surface;

an outer surface; and a plurality of channels formed between the inner surface and the outer surface and extending parallel with the inner surface and the outer surface;

each plurality of channels is formed by a fluted or corrugated sheet sandwiched between the respective inner surface and the respective outer surface;

a first sidewall of the plurality of sidewalls contacts two other sidewalls of the plurality of sidewalls; and one or more of the plurality of channels in the first sidewall is closed at opposing ends by the respective inner surfaces of the two other sidewalls, wherein:

the plurality of channels of the first sidewall extends in a direction parallel to the base; and the plurality of channels of the two other sidewalls extend in a direction perpendicular to the base.

19. A thermally insulative liner for a box, the liner comprising:

a base; and a plurality of sidewalls, each sidewall extending from the base thereby to define an opening opposite the base; wherein each of the plurality of sidewalls comprises:

an inner surface;

an outer surface; and a plurality of channels formed between the inner surface and the outer surface and extending parallel with the inner surface and the outer surface;

a first sidewall of the plurality of sidewalls contacts two other sidewalls of the plurality of sidewalls;

a width of the first sidewall, at least somewhere along its length, is greater than a width of the first sidewall at the base;

one or more of the plurality of channels in the first sidewall is closed at opposing ends by the respective inner surfaces of the two other sidewalls;

the plurality of channels of the first sidewall extends in a direction parallel to the base; and the plurality of channels of the two other sidewalls extend in a direction perpendicular to the base.

* * * * *